United States Patent [19]

Morell

[11] Patent Number: 4,943,059

[45] Date of Patent: Jul. 24, 1990

[54] GOLF CLUB HAVING REMOVABLE HEAD

[75] Inventor: Joseph Morell, Annecy, France

[73] Assignee: Salomon, S.A., Annecy Cedex, France

[21] Appl. No.: 201,874

[22] Filed: Jun. 3, 1988

[30] Foreign Application Priority Data

Jun. 16, 1987 [FR] France ..... 87-08390

[51] Int. Cl.[5] ..... A63B 53/02

[52] U.S. Cl. ..... 273/80.1; 273/80.2; 273/80.8; 403/364

[58] Field of Search ..... 273/80 R, 80.1–80.8, 273/80.9, 81.2, 79, 81.3, 80 C, 77 A, 73 J; 403/354, 339, 380, 364, 376, 356

[56] References Cited

U.S. PATENT DOCUMENTS

| | | | |
|---|---|---|---|
| 2,363,991 | 11/1944 | Reach | 273/80.2 |
| 2,470,406 | 5/1949 | Matzie | 273/80.3 |

FOREIGN PATENT DOCUMENTS

| | | | |
|---|---|---|---|
| 282301 | 12/1927 | United Kingdom | 273/80.3 |
| 353661 | 7/1931 | United Kingdom | 273/80.8 |
| 412662 | 7/1934 | United Kingdom | 273/80.3 |
| 0443439 | 3/1936 | United Kingdom | 273/80.8 |
| 518007 | 2/1940 | United Kingdom | 273/80.8 |

*Primary Examiner*—Edward M. Coven
*Assistant Examiner*—Sebastiano Passaniti
*Attorney, Agent, or Firm*—Sandler, Greenblum & Bernstein

[57] ABSTRACT

A golf club comprises a golf club head including a plug member containing a threaded axial bore. An elongated golf club shaft, containing an axially extending bore, has a connector portion at one axial end, and a gripper portion at the other axial end. A threaded rod is retained on the connector portion of the shaft, and is threaded into the axial bore of the plug member of the head for operatively connecting the shaft to the head.

20 Claims, 3 Drawing Sheets

1
2
3
4
5
5a
5b
6
10
11
12
13
14
15

GOLF CLUB HAVING REMOVABLE HEAD

BACKGROUND OF THE INVENTION

1. Field of the Invention

This invention relates to a golf club having a head removably mountable on the lower end of a shaft of the club.

2. Description of Background and Relevant Information

Golf clubs are currently available in which the head of a club is separate from the shaft, but can be removably mounted thereon. This design reduces the number of components that must be stocked by manufacturers and retailers. In effect, shafts of different lengths are manufactured and delivered to retailers, and heads of different types, appearances and different degrees of finish are also manufactured and delivered to retailers. The ability to stock unassembled heads and shafts reduces inventory requirements of both manufacturers and retailers because many different custom clubs can be constructed from the different shafts and heads.

While the provision for removably mounting heads on the lower ends of shafts of golf clubs undeniably has advantages with respect to a reduction in the number of components that must be stored, it is satisfactory to golfers only to the extent that the connection means between the heads and the shafts is properly designed. To be acceptable, such connection means must not only allow for easy and rapid assembly, but at the same time must be secure enough to eliminate concern about untimely disconnection. In addition, the connection means must be such as to be concealed from view for aesthetic reasons.

Various connection means have been envisioned, but those available to date have not achieved the objectives indicated above. It is therefore an object of the present invention to provide a golf club having a removable head wherein the connection between the shaft and the head is particularly simple in design, easy to use, and which provides for securely mounting the head to the shaft.

SUMMARY OF THE INVENTION

A golf club according to the present invention comprises a head including a club member containing a threaded axial bore, and an elongated golf club shaft containing an axially extending bore and having a connector portion at one axial end and a gripper portion at the other axial end. A threaded rod, retained on the connector portion of the shaft, is screwed into the axial bore of the plug member of the head for operatively connecting the shaft to the head.

Preferably, the threaded rod is in the form of a screw mounted on the shaft for rotation relative thereto about the axis of the bore in the shaft. The screw has a threaded shank screwed into the axial bore of the head, and a screw head for manually rotating the shank. Access to the screw head is gained from the gripper portion of the shaft.

According to one feature of the invention, means are provided, between the head and the connector portion of the shaft, for allowing the head to be affixed to the shaft in one of only two possible diametrically opposed positions with respect to the axis of the shaft.

BRIEF DESCRIPTION OF THE DRAWINGS

Non-limiting embodiments of the present invention are disclosed in the accompanying drawings wherein.

DETAILED DESCRIPTION

FIGS. 1–5 show the first embodiment of a golf club according to the present invention. The golf club comprises hollow shaft 1 having an axially extending bore and having the normal general shape of a slightly truncated, conical sleeve which converges from a gripper portion at the upper end of the sleeve to a connector portion at the lower end of the sleeve. Grip 2 at the gripper portion of the shaft is located on the extreme upper end of the sleeve, and removable head 3 is attached to the connector portion at the lower end of the sleeve. Head 3 includes inclined neck 4 which extends upwardly from the head and serves to link it with shaft 1.

Figure 1:
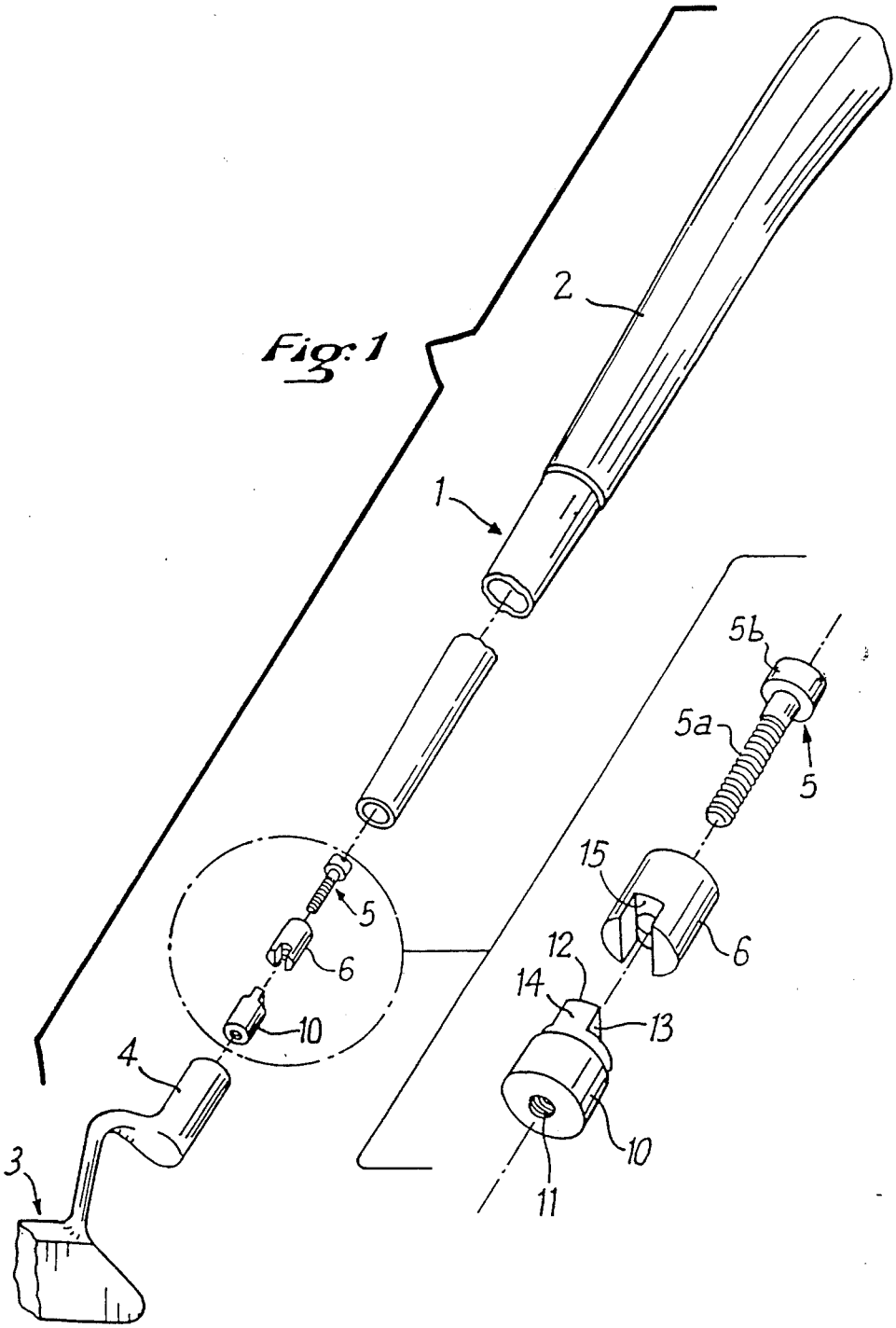
FIG. 1 is an exploded perspective view of a golf club according to the invention.
Figure 2:
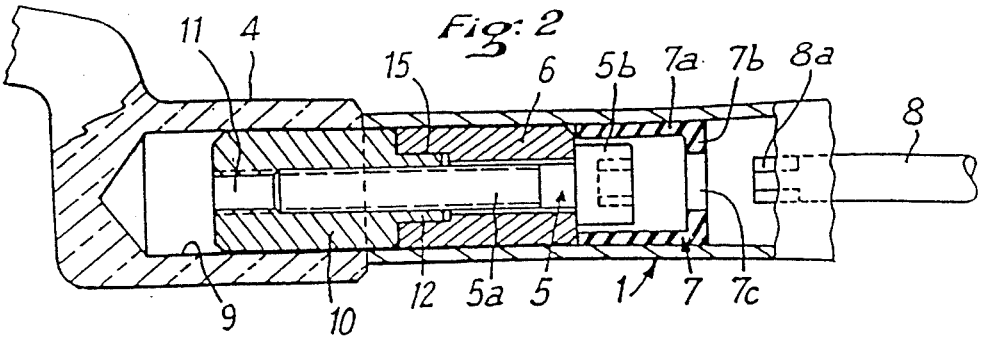
FIG. 2 is an axial cross-sectional view of the lower portion of a club showing details of connecting the shaft to the head according to the present invention.
Figure 4:
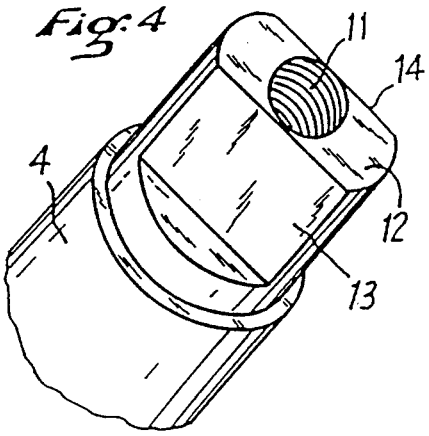
FIG. 4 is a perspective view of the upper portion of the neck of the head shown in FIG. 3.
Figure 5:
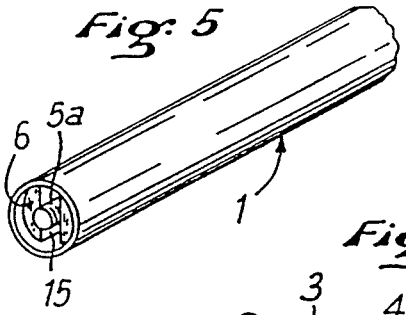
FIG. 5 is a perspective view of the lower end portion of the shaft of the golf club.
Figure 3:
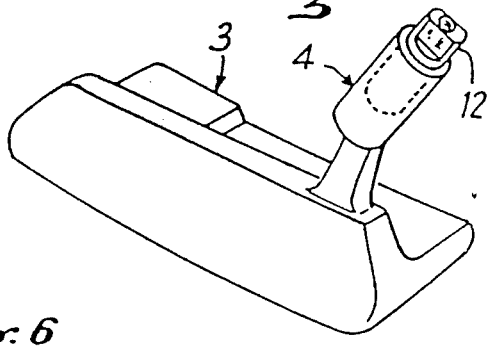
FIG. 3 is a perspective view of a head of golf club according to the present invention.

The connection between neck 4 and shaft 1 is achieved by axial screw 5 which is positioned in the extreme lower end of shaft 1. Threaded shank **5*a* of screw 5 freely passes through an axial aperture in plug 6 which is tightly nested in and affixed to the interior of the shaft, for example, by bonding. The free end of plug 6 is recessed within the shaft. Shank 5*a* preferably has a length sufficient to project axially beyond shaft 1, as can be seen in FIG. 5, when head 5*b* of the screw is engaged with plug 6 and located within the shaft. The front internal surface of plug 6 abuts internal cap 7 made of rubber or similar elastic material which is pressed into the bore in shaft 1. Cap 7 is retained at a selected axial position in the bore of the shaft by reason of the elasticity of the cap. Plug 6 and cap 7 serve as retaining means for retaining screw 5** to the shaft at the connector end thereof.

Cap 7 comprises peripheral skirt **7*a* in resilient contact with the internal surface of the bore in shaft 1. The open end of the cap, defined by the free end of the skirt, is turned towards the exterior, i.e., towards the internal front surface of plug 6 with which it may be in contact. Cap 7 further includes transverse bottom 7*b* on the other end of the skirt. Bottom 7*b* is provided with central hole 7*c*. The bottom of the cap is interposed between head 5*b* of screw 5 and the gripper portion of the shaft. The diameter of central hole 7*c* in bottom 7*b* is smaller than the external diameter of head 5*b* so that the head is trapped by the cap. The screw is thus retained to plug 6 but is nevertheless allowed a certain amount of free axial movement of the space defined between the front internal surface of plug 6 and the bottom 7b of cap 7. However, the size of hole 7c is sufficient to allow passage of end portion 8a of mounting and dismounting tool 8 whereby manual rotation of screw 5 can be effected from the gripper end of the shaft. End portion 8a is shaped in a manner so as to engage a complementary hollow portion of the same shape in head 5b. The preferred shape of end portion 8a and the hollow portion of head 5b** is hexagonal.

Neck 4 of head 3 is provided with a plug member having a threaded axial bore. The plug member comprises plug 10 nested in bore 9 in neck 4 and fixed in the bore by appropriate means such as bonding, for example. Plug 10 contains through axial bore 11 that is threaded. Shank 5a of screw 5 is screwed into axial bore 11.

An axial end of plug 10 in neck 4 engages an axial end of plug 6 affixed to shaft 1 when the shaft is operably connected to the head. The engaged axial ends of the plugs have complementary shapes that nest one within the other. Preferably, the complementary shapes are such that only two orientations of head 3 with respect to shaft 1 are possible. These two positions are diametrically opposed with respect to the axis of shaft 1.

In the embodiment of the invention shown in FIGS. 1–5, axial projection 12 on one axial end of plug 10 projects beyond neck 4 of head 3. Projection 12 is defined by two parallel, longitudinal flat portions 13 and 14 symmetrically positioned with respect to a diametral plane passing through the axis of the plug. Projection 12 engages complementary notch 15 in the external front surface of plug 6. Notch 15 is diametrically located and is of the same width as that of projection 12. Thus, the male portion, which constitutes projection 12 fixed to neck 4, mates with the female portion that constitutes notch 15 of plug 6. As a consequence, head 3 can be mounted in either of only two positions which are 180° apart. In this manner, the head can be mounted to the right or to the left with respect to a reference plane passing through the axis of the shaft and constituted by the axial plane of symmetry of projection 12 and notch 15.

Figure 6:
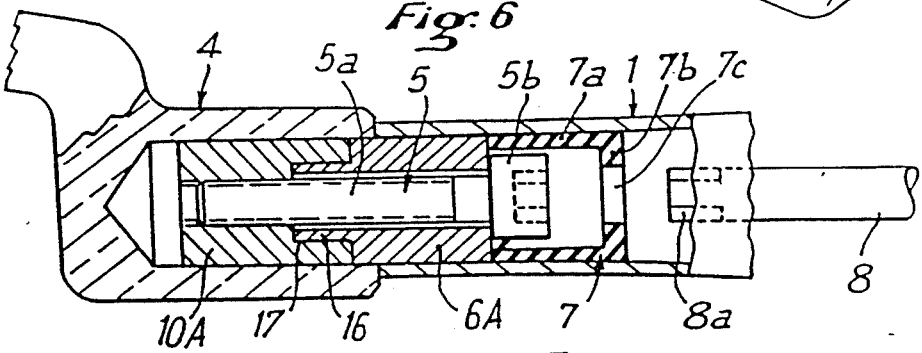
FIG. 6 is an axial cross-sectional view similar to the view of FIG. 2 but showing an alternative embodiment of the present invention.

In the embodiments of the invention shown in FIG. 6, the gender of the mating portions is reversed. That is to say, the axial end of plug 6A projects slightly from the free end of the connector portion of shaft 1; and axial projection 16 projects therefrom. Projection 16 is defined by two parallel opposed longitudinal flat portions which are symmetrical with respect to a diametral plane passing through the axis of plug 6A. Projection 16 is engaged in diametral notch 17 of the same width provided in the external front surface of plug 10A nested in the bore in neck 4 of the head. As shown, the axial end of plug 10A is slightly retracted with respect to the front surface of neck 4.

Figure 7:
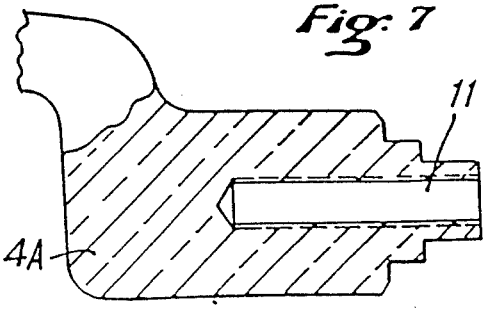
FIG. 7 is an axial cross-sectional view of another embodiment of the neck of the head.
Figure 8:
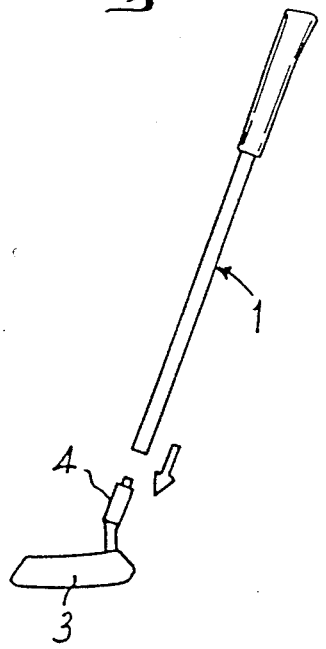
FIGS. 8–11 are schematic views illustrating the various phases of an assembly operation by which the head is attached to the lower end of the shaft of the golf club.
Figure 9:
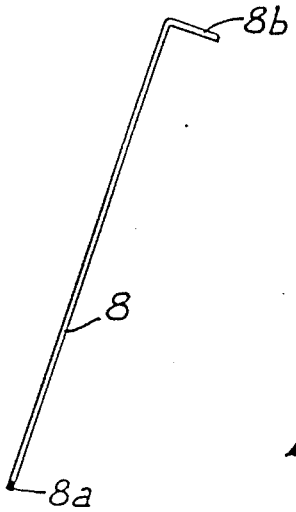
Figure 10:
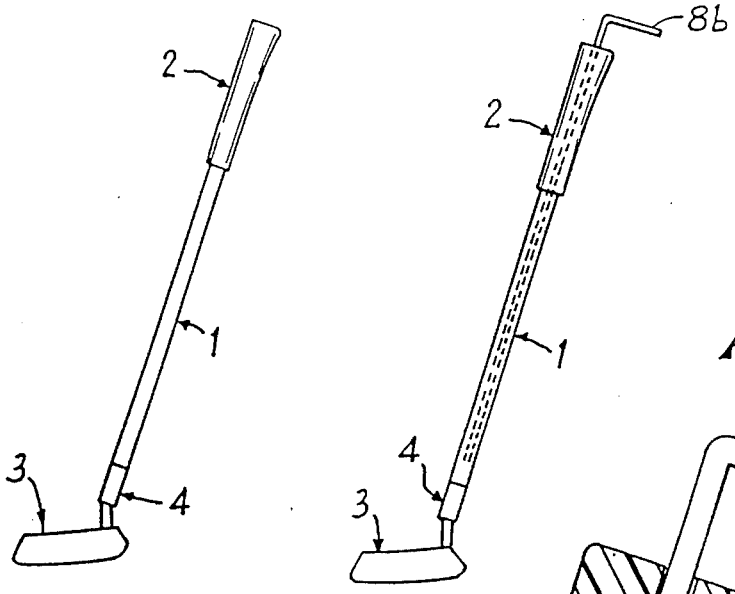
Figure 11:
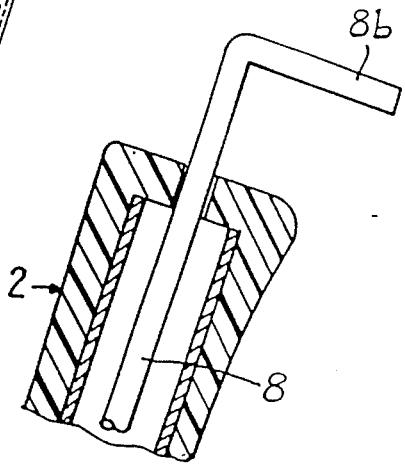

In the embodiment of the invention shown in FIG. 7, the plug means is integral with the head eliminating the need for a separate plug. In this embodiment, tapped axial bore 11 is formed directly in neck 4A of the head.

FIGS. 8–11 illustrate the manner in which head 3 is affixed to or removed from the lower end of the connector portion of shaft 1. To attach a head to a shaft, the front surface of projection 12 on plug 10 attached to head 3 is inserted into notch 15 of plug 6 provided in the lower end portion of shaft 1. Screw 5 is retained within shaft 1 by cap 7 as described above, and is free to rotate and to move in an axial direction. The mating of the plugs slightly pushes screw 5 towards the interior of the shaft. This free movement towards the interior is made possible because head 5b of screw 5 can be displaced to a limited extent within cap 7. At this point, mounting and dismounting tool 8 may be introduced into the open upper end of the gripper portion of the shaft and passed axially along the shaft.

Tool 8 is constituted by a shaft that is sufficiently small in cross-section and sufficiently long so as to be able to pass through the entire length of shaft 1 until lower end 8a of the mounting tool is operatively engaged with head 5b of the screw. End 8a has a shape complementary to that of the hollow provided in the head of screw 5b. If this hollow has the hexagonal shape, then end portion 8 constitutes a hexagonal head engagable in the hollow of the screw 5b by passing end 8a through central hole 7c of cap 7. The upper end of shaft 8 is constituted by gripping handle 8b.

After end 8a operatively engages head 5a of the screw, the mounting tool may be rotated in a clockwise direction around its axis by manual application of torque to handle 8b. As a consequence, threaded shaft 5a of screw 5 is screwed into tapped bore 11 of tip 10. This serves to firmly lock neck 4, and consequently head 5, against the lower end of shaft 1.

The disassembly of head 3 occurs in a reverse manner by inserting mounting tool 8 through shaft 1 and causing end 8a to operatively engage head 5a of the screw. The tool may now be turned in a counter-clockwise direction to unscrew shank 5a from bore 11.

Although the invention has been described with reference to particular means, materials and embodiments, it is to be understood that the invention is not limited to the particulars disclosed and extends to all equivalence within the scope of the pending claims.

I claim:

1. A golf club comprising:

(a) a golf club head including a plug member containing a threaded axial bore;

(b) an elongated golf club shaft having a connector portion at one axial end and a gripper portion at the other axial end, said golf club shaft containing an axially extending bore;

(c) a screw retained on the connector portion of said shaft and threaded into said threaded axial bore of said plug member of said golf club head for operatively connecting said golf club shaft to said golf club head, wherein said screw is mounted on said golf club shaft for rotation about an axis of said bore of said golf club shaft, said screw having a threaded shank screwed into the axial bore of said golf club head, and having a screwhead for manually rotating said shank, said screwhead being accessible from said gripper portion of said shaft; and (d) a retention means for retaining said screw on said golf club shaft, said retention means comprising:

(i) a plug carried by said golf club shaft at its connector portion, said plug having an axial aperture for slidably receiving the shank of said screw when the screwhead is positioned in the bore of said golf club shaft, whereby engagement of the screwhead with the plug limits axial displacement of the screw in one direction; and (ii) an elastic cap resiliently engaged with the bore of said golf club shaft adjacent the plug of said retention means, wherein said cap comprises a peripheral skirt resiliently engaged with the interior of the bore in said golf club shaft, a transverse bottom at one end of said skirt, and wherein the other end of said skirt terminates in a free end that is open and faces the plug of said retention means, the bottom of said cap being interposed between the screwhead and the gripper portion of the golf club shaft, said bottom containing an aperture of the size smaller than the size of the screwhead, whereby said cap serves to capture the screw and to effect limited axial displacement of said screw relative to said plug member.

2. A golf club according to claim 1 wherein the screwhead is provided with tool means adapted to be engaged by complementary tool means on the free end of a tool inserted into the shaft from the gripper end, thereof, and passed through the aperture in the transverse bottom of the said cap.

3. A golf club according to claim 2 wherein the free end of said peripheral skirt of said cap engages the plug of said retention means.

4. A golf club according to claim 2 wherein said plug member of said head includes a plug nested in an axial bore in said head, said plug containing said threaded axial bore.

5. A golf club according to claim 4 wherein the plug of said head is bonded to the axial bore, therein.

6. A golf club according to claim 4 wherein the axial ends of each of the plugs are engaged when the head is operatively connected to said shaft, the engaged axial ends of the plugs being constructed and arranged so that said head is selectively orientable in a plurality of different angular positions on said shaft.

7. A golf club according to claim 6 wherein the engaged axial ends of the plugs are constructed and arranged so that said head is orientable in one of only two possible positions.

8. A golf club according to claim 7 wherein the two positions are 180° apart.

9. A golf club according to claim 6 wherein one of the plugs includes parallel flat portions, and the other of the plugs has a complementary notch for receiving said flat portions when the shaft is operably connected to said head.

10. A golf club according to claim 9 wherein the parallel flat portions are symmetrical about a diametral plane passing through the axial bore of the plug having the flat portions.

11. A golf club according to claim 10 wherein the plug having the flat portions is a part of the retention means.

12. A golf club according to claim 10 wherein the plug having the flat portions is on the head.

13. A golf club according to claim 10 wherein the axial end of the plug of the retention means which engages the plug of the head is recessed within the bore of the shaft.

14. A golf club according to claim 10 wherein the axial end of the plug of the head which engages the plug of the retention means is recessed within the bore in the head.

15. A golf club comprising:

(a) an elongated golf club shaft having a connector portion at one axial end and a gripper portion at the other axial end, said shaft containing an axially extending bore; and (b) a golf club head including a plug member containing a threaded axial bore, wherein said plug member of the golf club head includes a plug nested in an axial bore in said golf club head, said plug containing said threaded axial bore, wherein axial ends of said plug are engaged when the golf club head is operatively connected to said golf club shaft, said axial ends of said plug being constructed and arranged so that said golf club head is selectively orientable in a plurality of different angular positions on said golf club shaft;

(c) a screw retained on the connector portion of said golf club shaft and threaded into said axial bore of said plug member of said golf club head for operatively connecting said golf club shaft to said golf club head, wherein said screw is mounted on said golf club shaft for rotation about an axis of the bore of said golf club shaft, said screw having a threaded shank screwed into the axial bore of said golf club head, and having a screwhead for manually rotating said shank, said screwhead being accessible from said gripper portion of said golf club shaft; and (d) a retention means for retaining said screw on said golf club shaft, said retention means including a plug carried by said shaft at its connector portion, said plug having an axial aperture for slidably receiving the shank of said screw when the screw head is positioned in the bore of said golf club shaft, whereby the engagement of the screw head with the plug limits axial displacement of the screw in one direction.

16. A golf club according to claim 15 wherein one of the plugs includes parallel flat portions, and the other of the plugs has a complementary notch for receiving said flat portions when the shaft is operatively connected to the head.

17. A golf club according to claim 16 wherein the parallel flat portions are symmetrical about a diametral plane passing through the axial bore of the plug having the flat portions.

18. A golf club according to claim 17 wherein the plug having the flat portions is a part of the retention means.

19. A golf club according to claim 17 wherein the plug having the flat portions is on the head.

20. A golf club comprising:

(a) a golf club head including a plug member containing a threaded axial bore;

(b) an elongated golf club shaft having a connector portion at one axial end and a gripper portion at the other axial end, said shaft containing an axially extending bore;

(c) a screw retained on the connector portion of said golf club shaft and threaded into said threaded axial bore of the plug member of said golf club head for operatively connecting said golf club shaft to said golf club head, wherein said screw is mounted on said golf club shaft for rotation about an axis of said bore of said golf club shaft, said screw having a threaded shank screwed into said axial bore of said golf club head, and having a screwhead for manually rotating said shank, said screwhead being accessible from said gripper portion of said shaft;

(d) a retention means for retaining said screw to said shaft wherein said retention means includes (i) a plug carried by said shaft at its connector portion, said plug having an axial aperture for slidably receiving the shank of said screw when the head, thereof, is positioned in the bore of said shaft, whereby engagement of the screw head with the plug limits axial displacement of the screw in one direction; and (ii) an elastic cap resiliently engaged with the bore of said shaft adjoining the plug of said retention means, said cap serving to limit axial displacement of said screw in a direction opposite to said one direction.

* * * * *